US005641079A

United States Patent [19]

Schmidt

[11] Patent Number: 5,641,079

[45] Date of Patent: Jun. 24, 1997

[54] TOOL HOLDER

[75] Inventor: Sheldon Schmidt, Paramus, N.J.

[73] Assignee: Great Neck Saw Manufacturers, Inc., Mineola, N.Y.

[21] Appl. No.: 489,047

[22] Filed: Jun. 9, 1995

[51] Int. Cl.[6] ..... A47F 5/00

[52] U.S. Cl. ..... 211/70.6; 211/70.1; 211/104

[58] Field of Search ..... 211/70.1, 70.6, 211/104, 73, 60.1

[56] References Cited

U.S. PATENT DOCUMENTS

| | | | |
|---|---|---|---|
| 2,931,515 | 4/1960 | Rubin | 211/70.1 |
| 2,971,654 | 2/1961 | Whorton | 211/73 |
| 3,187,902 | 6/1965 | Nelson | 211/70.6 |
| 3,269,550 | 8/1966 | Marcus | 211/70.6 |
| 3,603,551 | 9/1971 | Peterson | 211/70.6 X |
| 4,343,172 | 8/1982 | Nordlund | 211/70.1 X |
| 4,365,720 | 12/1982 | Kaneshiro | 211/70.6 |
| 4,653,637 | 3/1987 | Wallace | 211/70.1 |

*Primary Examiner*—Robert W. Gibson, Jr.
*Attorney, Agent, or Firm*—Joseph J. Previto

[57] ABSTRACT

A tool holder having three panels, the panels being foldable relative to each other from a flat position to an assembled position, one of the panels having openings therein, the one panel is foldable relative to the other panel to assume a position at an angle to the other panel. The three panels consist of an upper panel, a central panel and a lower panel and the openings are in the lower panel. A tool may be placed in the openings in the panel.

12 Claims, 2 Drawing Sheets

TOOL HOLDER

BACKGROUND

The present invention relates to a tool holder and more particularly to a foldable tool holder for holding a tool, such as a screwdriver, when the tool is not in use.

The invention will be described in connection with a holder for a screwdriver. However, it will be understood that it is within the purview of the present invention to use the present invention with other tools if desired.

When tools are not in use it is advantageous for the tools to be stored in a readily accessible place so that they can be retrieved when it is necessary to use them again. In many instances, after they are used, the tools are merely placed in a drawer, or the like, together with other tools, and it is sometimes difficult to find a particular tool when it is necessary to use it. At other times, the tools are misplaced or left in some forgotten place so that they are difficult to find.

Present tool holders are bulky and are not capable of laying flat. They are not capable of being hung on a pegboard, or alternately, being mounted on a wall by screws or the like. In addition, existing tool holders are not capable of being assembled from a flat position to an upright position. Hence, it is expensive to package existing tool holders, to ship existing tool holders and to store them until they are sold or used since they cannot be packaged, shipped or stored flat.

OBJECTS

The present invention avoids these problems and has for one of its objects the provision of an improved tool holder which is easily assembled from a flat inoperative position to an upright operative position to hold a tool, such as a screwdriver.

Another object of the present invention is the provision of an improved tool holder which can be either affixed to a wall by a fastener, such as a screw, or can be hung from a pegboard.

Another object of the present invention is the provision of an improved toolholder which may lie flat when not in its operative position but which may easily be assembled to an upright operative position.

Another object of the present invention is the provision of an improved tool holder which may be made in one piece.

Another object of the present invention is the provision of an improved tool holder which is easy to operate.

Another object of the present invention is the provision of an improved tool holder which is inexpensive to the manufacturer, package, ship and store.

DRAWINGS

A preferred embodiment of the invention has been chosen for purposes of illustration and description and is shown in the accompanying drawings forming a part of the specification, wherein.

DESCRIPTION

Figure 2:
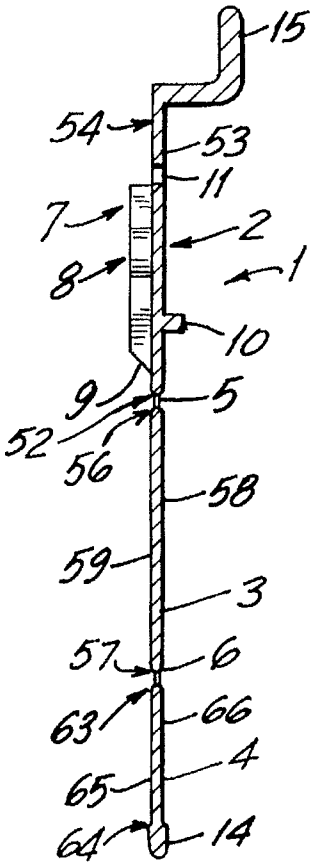
FIG. 2 is a sectional view taken along line 2—2 of FIG. 1.
Figure 1:
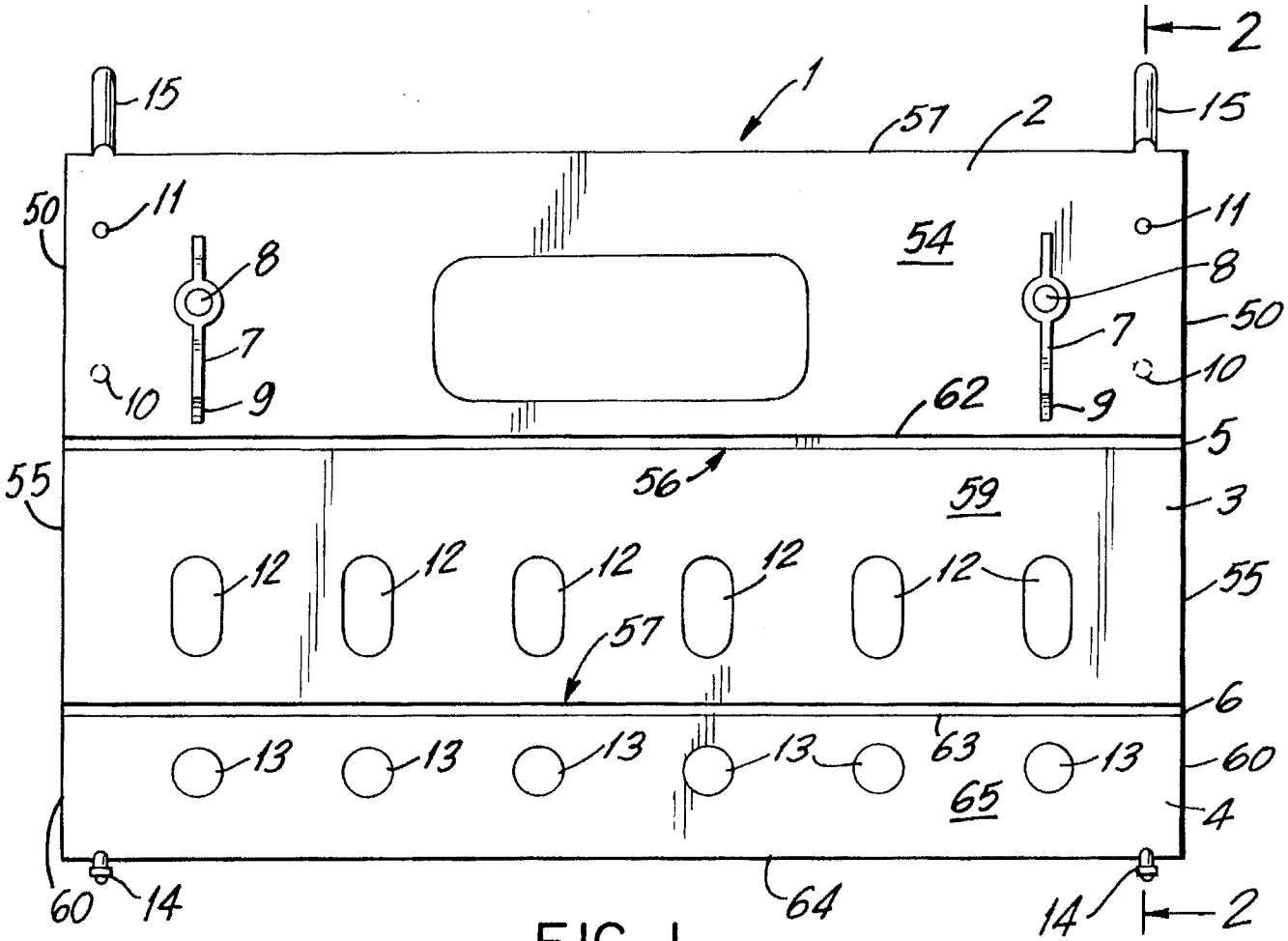
FIG. 1 is a plan view of a tool holder made in accordance with the present invention.

Referring to the drawings and more particularly to FIGS. 1 and 2, the tool holder 1 of the present invention comprises an upper panel 2, a central panel 3, and a lower panel 4. The upper panel 2 has opposed end edges 50, a top edge 51, a bottom edge 52 and outer and inner faces and 54, respectively. Central panel 3 has opposed end edges 55, a top edge 56 a bottom edge 57 and inner and outer faces 58 and 59, respectively. Lower panel 4 has opposed end edges 60, top edge 62, bottom edge 64 and inner and outer faces 65 and 66, respectively. Panels 2 and 3 are connected together by hinge element 5 along the edges 52 and 56, respectively, and panels 3 and 4 are connected together by hinge element 6 along the edges 57 and 63, respectively. Preferably, the hinge elements 5 and 6 are shown as reduced thickness portions of the panels 2, 3 and 4 and as being integral with the panels 2, 3 and 4. However, it is within the purview of the present invention for the hinge elements 5 and 6 to be separate hinge means to which the panels 2, 3 and 4 are affixed. In addition, it is also within the scope of the present invention for the hinges to be fold lines or printed fold marks to indicate where the panels 2, 3 and 4 are to be folded.

The upper panel 2 is provided with a pair of spacers, 7 extending from its outer face 54. Each spacer 7 has an opening 8 therein for accommodating a screw or similar fastener element. Each spacer 7 is an elongated, thin, element. The spacers 7 are shown as substantially parallel to each other and to the end edges 50 and being at the same level with each other with respect to the upper and lower edges 51–52. The lower edge 9 of each spacer element 7 is at an angle to the front face 54 of the upper panel 2.

On the rear face 53 of the upper panel 2 there is provided a pair of spacers 10 extending rearwardly from the rear face 53. The spacers 10 are preferably located adjacent the end edges 50 of the upper panel 2. The upper panel 2 is also provided with a pair of openings 11 which are shown as being adjacent to the upper edge 51 and spaced inwardly from end edges 50. A pair of upwardly extending pegboard hooks 15 are provided on upper edge 51 of the upper panel 2. The hooks extend rearwardly and upwardly from rear face 53 and are used to attach the tool holder 1 to a pegboard 16 (FIGS. 3–4) or similar support structure.

The central panel 3 is provided with a plurality of openings 12 which are to accommodate a tool. Preferably, the openings 12 are shown as being elongated to be able to accommodate tools of different sizes and to give some leeway when the central panel 3 is placed in an angled position when the holder 1 is in its folded assembled position as show in FIGS. 3–6. However, it will be understood that openings 12 may be made of a different size and shape without departing from the invention.

The lower panel 4 is also provided with a plurality of openings 13 which are in axial alignment with the openings 12 in the central panel 3 and which will cooperate with the openings 12 in the central panel 3 to hold a tool in place. It will be noted that the openings 13 in the lower panel 2 are shown as being circular. However, it is within the purview of the present invention for the shape and size of both of the openings 12 and 13 to be different than those shown in the drawings without departing from the scope of the invention.

Extending from the lower edge 64 of the lower panel 4 there are a pair of spaced plug elements 14. These plug elements 14 are in alignment with the openings 11 in the top panel 2 and are adapted to be inserted into the openings 11 of the top panel 2 when the tool holder 1 is assembled as shown in FIGS. 3–6.

Figure 3:
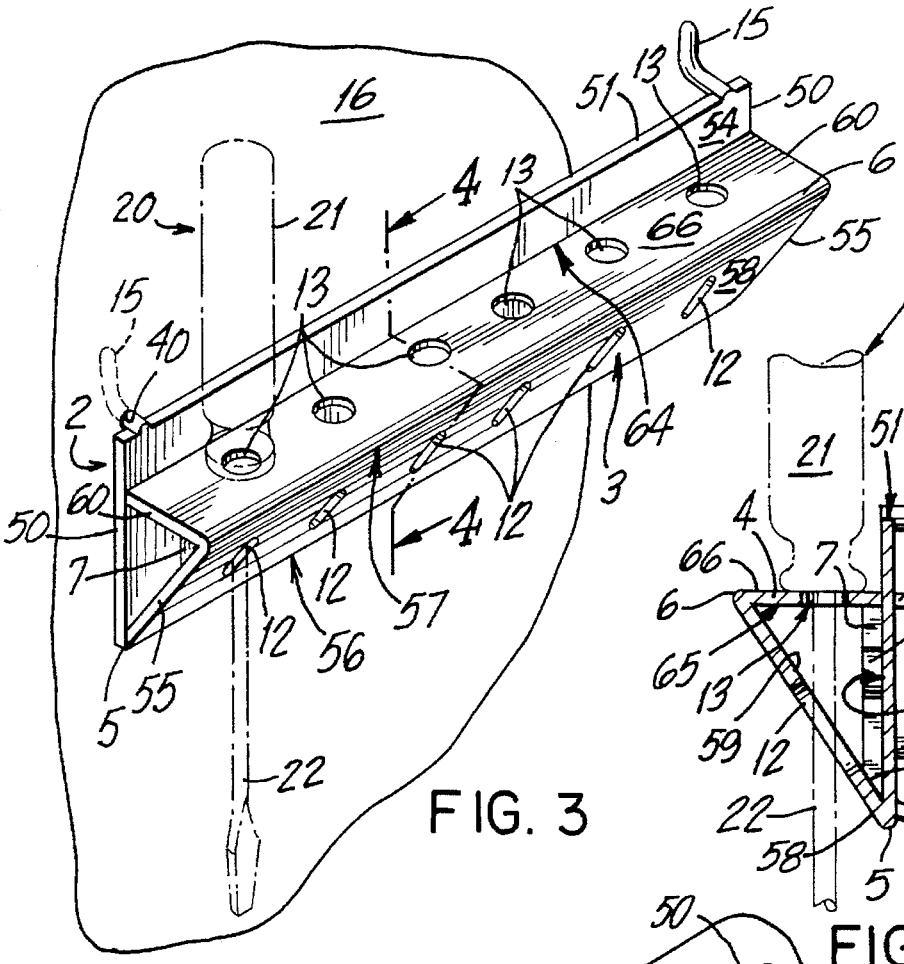
FIG. 3 is a perspective view showing the tool holder in assembled position for mounting on a pegboard.
Figure 4:
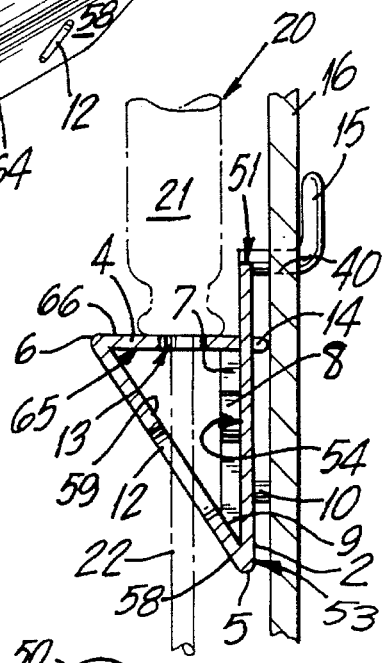
FIG. 4 is a sectional view taken along line 4—4 of FIG. 3.

Referring to FIGS. 3 and 4, the tool holder 1 is shown as being assembled for mounting on a pegboard 16 or similar support structure. The tool holder 1 is folded inwardly along the fold lines 5 and 6 so that the outer faces 54, 59 and 65 of panels 2, 3 and 4, respectively, face each other. In this position, central panel 3 is at an acute angle to the top and bottom panels 2 and 4, respectively, and the bottom panel 4 is substantially at right angles to the top panel 2. The folded panels 2, 3 and 4 are held in place in a generally right-triangular position with the plug elements 12 being inserted into the openings 11 in top panel 2 as shown in FIGS. 3 and 4 to hold the assembled structure together. It will be noted that the holder 1 is folded along the fold lines 5 and 6 so that the outer face 54 of the upper panel 2 above the level of the horizontally oriented upper panel 4 is in view but the remainder of its outer face 54 below the level of the upper panel 4 as well as the outer faces 59 and 65 of the central and lower panels 3 and 4, respectively, are not visible since they are folded inwardly toward each other.

As shown in FIGS. 3 and 4, the hooks 15 are inserted into openings 40 in a pegboard 16 so that the tool holder 1 hangs down ready to be used. The spacers 10 which extend rearwardly from rear face 53 will strike the pegboard 16 (as shown in FIG. 4) to keep the tool holder 1 in a substantially vertically hanging position. The lower end 9 of the spacers 7 is angled to permit the central panel 3 to be folded and be placed at an angle (FIG. 3) relative to top panel 2. The openings 13 and 12 in the lower and central panels 4 and 3, respectively, are now in alignment with each other and are ready to receive a tool which may be a screwdriver 20 (shown in phantom) having a handle 21 and a shank 22. The shank 22 is inserted through the opening 13 in the horizontally oriented lower panel 7 (at a right angle to upper panel 2), and through the opening 12 in the angled central panel 3 which is in alignment therewith. It will be noted that since the opening 12 in the central panel 3 is elongated, it will accommodate the shaft 22 of a screwdriver 20 even though the central panel 3 is at an angle. It will further be noted that the handle 21 of the screwdriver 20 will rest on top of the horizontally oriented lower panel 2. In this manner, a plurality of screwdrivers 20 may be mounted in the holder 1 for storage and will be readily available when they are to be used.

Figure 5:
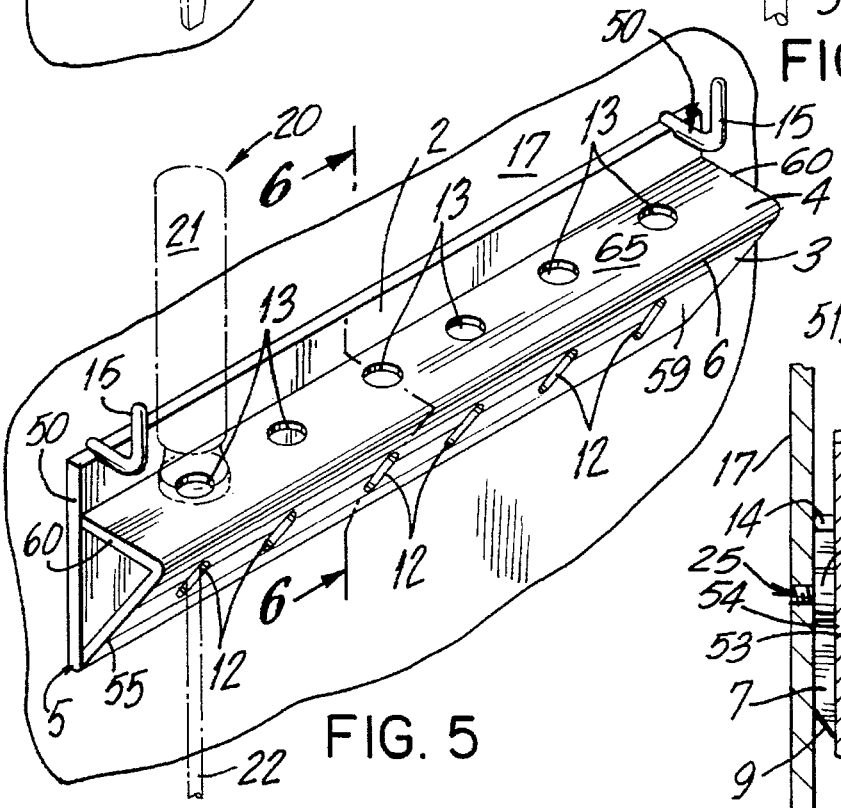
FIG. 5 is a perspective view of the tool holder in assembled position for mounting to a wall.
Figure 6:
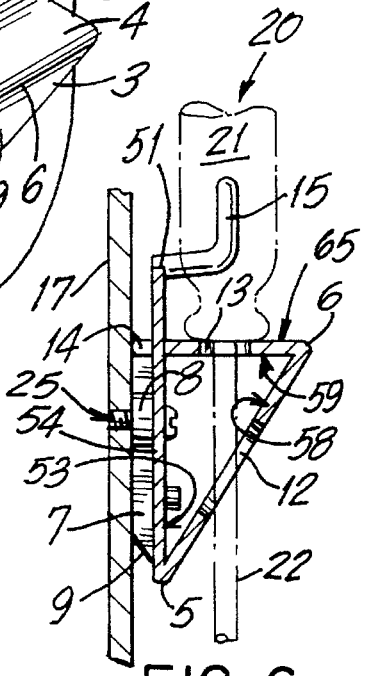
FIG. 6 is a sectional view taken along line 6—6 of FIG. 5.

Referring to FIGS. 5 and 6 of the drawings, the holder of the present invention is capable of being assembled by being screwed or otherwise mounted into a wall 17 or similar support structure. In this instance, the tool holder 1 is reversed so that the rear faces 53, 58, and 59 of the panels 2, 3 and 4 now face outwardly away from wail 17. The upper panel 2 is screwed to the wall 17 by screws 25 extending through the upper panel 2 and through the openings 8 in the spacer 7 and into a wall 16 from which the tool holder 1 hangs. It will be noted that in this manner, the pegboard hooks 15 now face outwardly. It will also be noted that the spacers 7 are against the wall 16 to space the top panel 2 from the wall 16 itself. The central panel 3 and the lower panel 4 are folded relative to each other to a position shown in FIGS. 5–6, which is similar to the position of the folded holder shown in FIGS. 3–4. However, in this instance, the folding of the panels 2, 3 and 4 are about the rear faces of the tool holder 1 so that the upper portion of rear face 53 of the top panel 2 above the level of the horizontally oriented bottom panel 4 is in view but the remainder of its rear face 53 below the level of the bottom panel 4 and the rear faces 58 and 66 of the central and lower panels 3 and 4, respectively, are not visible since they are folded inwardly toward each other. When the tool holder is folded in this manner, the shank 22 of a screwdriver 20 is placed in the opening 12 in the horizontally oriented lower panel 4 until the handle strikes the lower panel 4 itself. The shaft of the screwdriver 20 extends through the openings 12 and 13 in the lower and central panel 3 and 4, respectively, in a manner similar to the manner shown and described in FIGS. 3–4.

It will thus be seen that the present invention provides an improved tool holder which is easily assembled from a flat inoperative position to an upright operative position, which can be either affixed to a wall by a fastener, such as a screw, or can be hung from a pegboard, which may lie flat when not in its operative position but which may easily be assembled in an upright position, which may be made in one piece, which is easy to operate and which is inexpensive to the manufacturer, package, ship and store.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A tool holder comprising at least three panels, said panels being foldable relative to each other from a flat position to an assembled position, at least one of the panels having at least one opening therein, one of said panels being foldable relative tot he other panel to assume a position at an angle to the other panel whereby a foll may be placed in said opening, said three panels comprising an upper panel, a central panel, and a lower panel, said opening being in at least said lower panel, each of said panels having afront face and a rear face, said panels being foldable relative to each other whereby the lower panel is removably attached to the upper panel when in said assembled position, an said lower panel is substantially perpendicular to the upper panel when in said assembled position.

2. A tool holder as set forth in claim 1 wherein said central panel is at an angle between said upper and lower panels when in said assembled position.

3. A tool holder as set forth in claim 2 wherein openings are provided in the central panel in axial alignment with the openings in the upper panel.

4. A tool holder as set forth in claim 3 wherein attachment openings provided in the upper panel to receive attachment elements extending from the lower panel to maintain the tool in said assembled position whereby the three panels comprise substantially a right triangle when in said assembled position.

5. A tool holder as set forth in claim 4 wherein spacer means extend from the front face of the upper panel.

6. A tool holder as set forth in claim 4 wherein spacer means extend from the rear face of the upper panel.

7. A tool holder as set forth in claim 4 wherein pegboard mounting means extend from the upper panel.

8. A tool holder as set forth in claim 7 wherein when in said assembled position the front faces of the three panels face each other.

9. A tool holder as set forth in claim 4 wherein means are provided to attach the upper panel to a wall.

10. A tool holder as set forth in claim 9 wherein said attaching means comprise fastener-receiving means on the upper panel.

11. A tool holder as set forth in claim 10 wherein when assembled the rear faces of the three panels face each other.

12. A tool holder as set forth in claim 4 wherein the openings in the central panel are elongated.

* * * * *